United States Patent [19]

Romanelli

[11] Patent Number: 4,715,160

[45] Date of Patent: Dec. 29, 1987

[54] SET OF STANDARDIZED STRUCTURAL ELEMENTS AND ACCESSORIES FOR THE ACCOMPLISHMENT OF SPATIAL AND/OR FLAT STRUCTURES WHICH CAN BE COMBINED TO DELIMIT HABITABLE SPACES IN AN INDUSTRIALIZED BUILDING SYSTEM

[76] Inventor: Luciano Romanelli, (Bari), Trani Strada Statale N. 16-Km. 762, Italy, 70059

[21] Appl. No.: 853,401

[22] Filed: Apr. 18, 1986

[30] Foreign Application Priority Data

Apr. 24, 1985 [IT] Italy ..... 20465 A/85

[51] Int. Cl.[4] ..... E04H 12/00

[52] U.S. Cl. ..... 52/648; 52/81; 52/650; 52/694; 52/DIG. 10; 403/171; 403/172

[58] Field of Search ..... 52/80, 81, 634–636, 52/648–655, DIG. 10, 694; 403/170–178

[56] References Cited

U.S. PATENT DOCUMENTS

| | | | |
|---|---|---|---|
| 1,865,059 | 6/1932 | Ragsdale | 52/694 |
| 2,216,732 | 10/1940 | Brown | 52/648 |
| 3,447,278 | 6/1969 | Collins | 52/634 |
| 3,918,233 | 11/1975 | Simpson | 52/81 X |
| 4,438,616 | 3/1984 | Codd | 52/650 |

FOREIGN PATENT DOCUMENTS

| | | | |
|---|---|---|---|
| 520413 | 6/1921 | France | 52/650 |

*Primary Examiner*—William F. Pate, III
*Assistant Examiner*—Richard E. Chilcot, Jr.
*Attorney, Agent, or Firm*—Murray and Whisenhunt

[57] ABSTRACT

Rod elements with variable section, straight and discontinuous allow erection of flat and spatial structures. There are also provided flat panels with turned back edges and surface lining panels which can be associated with said flat panels as well as roofing panels which can be partially overlapped. Angle elements with L-section allow joining of several structures in miter, T and cross joints.

16 Claims, 38 Drawing Figures

Figure 1:
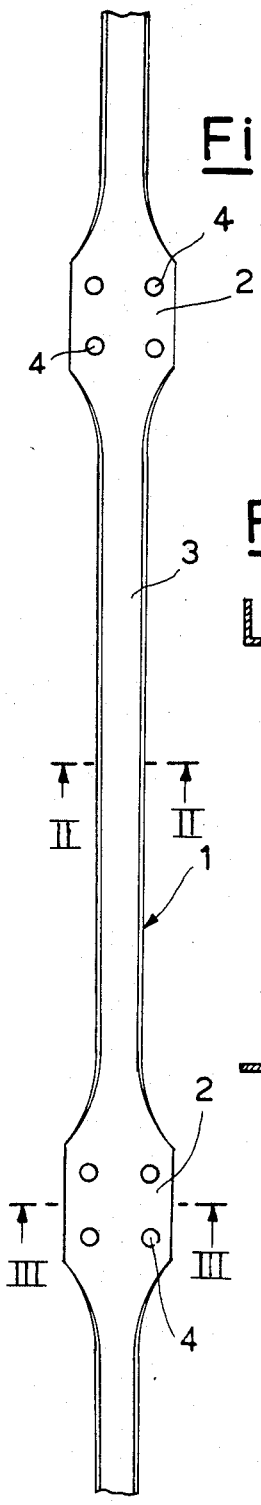

1
2
3
4
VII
VIII
X
XI 5
6
7
8
13
14
15
16
XIII
XIV
XXI

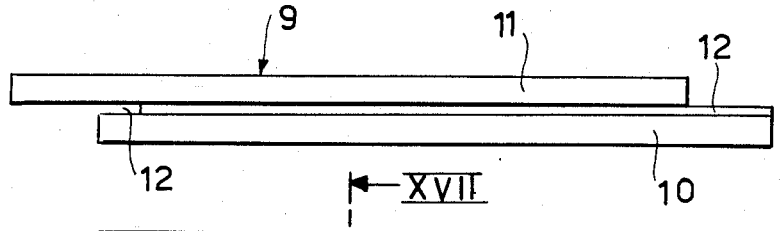
Fig.16
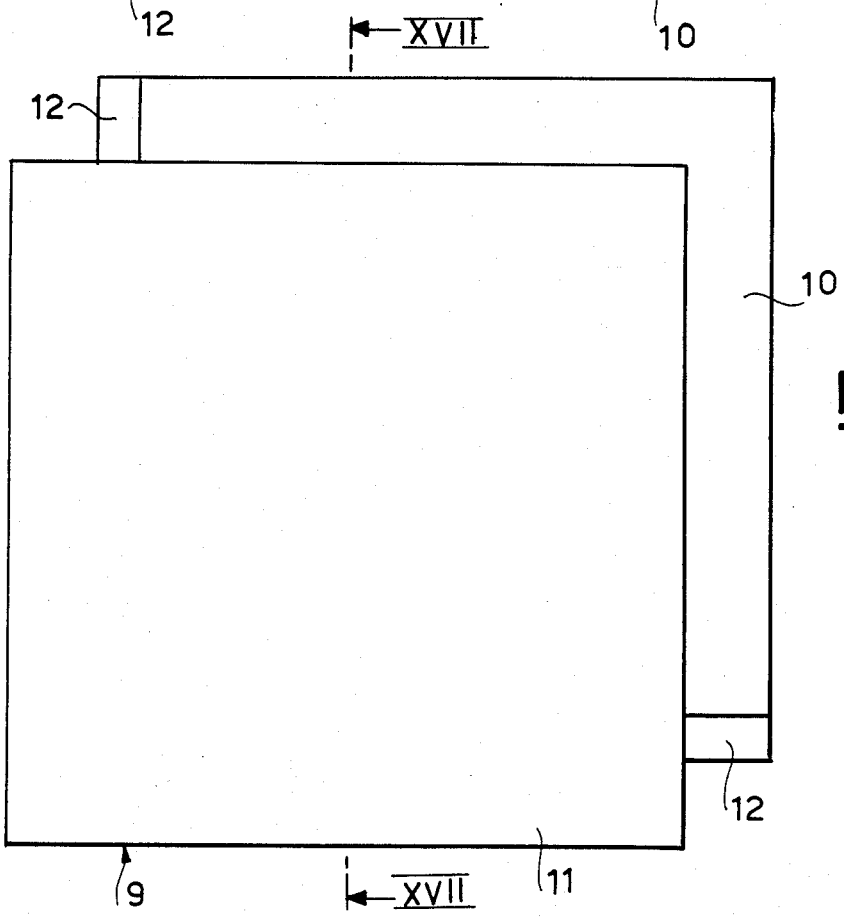
Fig.15
Fig.17
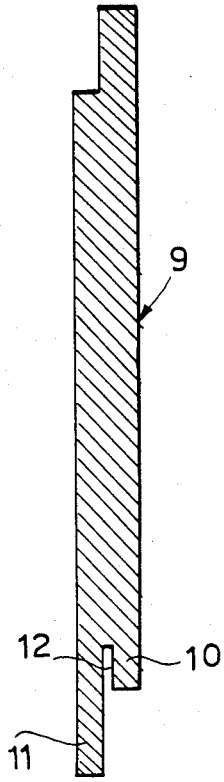

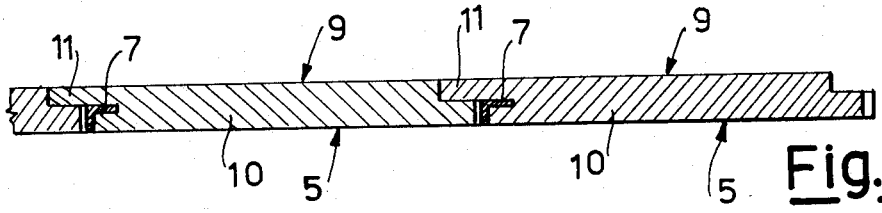
Fig.30
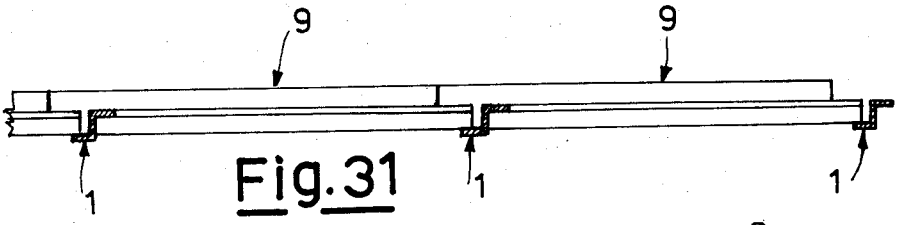
Fig.31
Fig.29
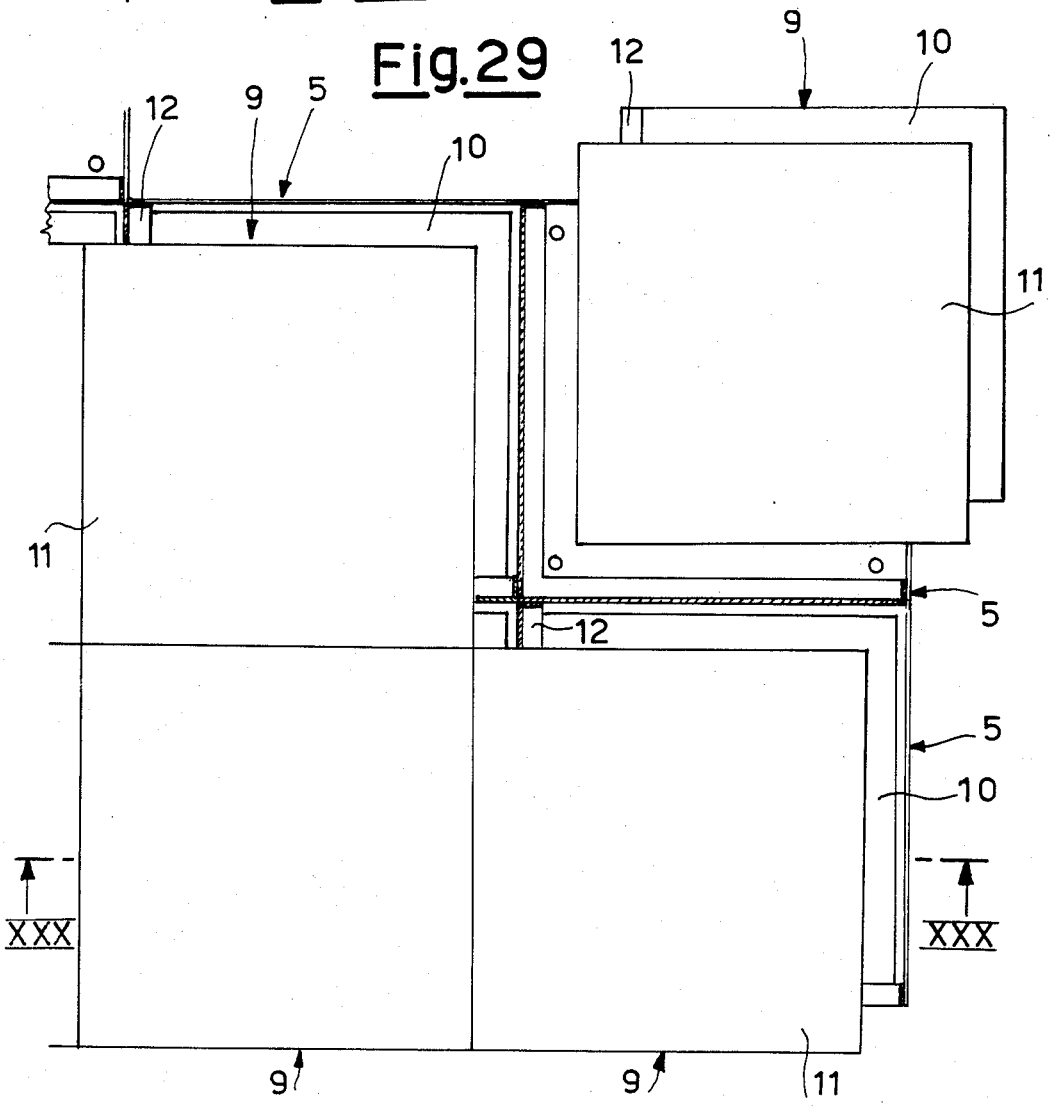

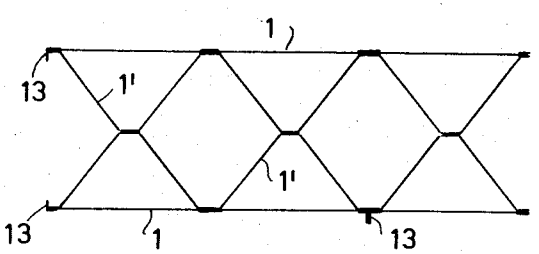
Fig.37
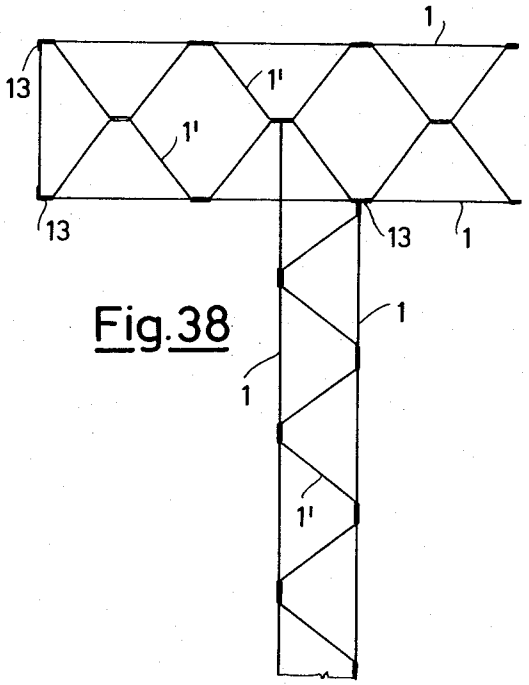
Fig.38
Fig.36
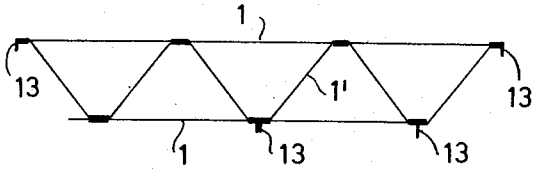
Fig.35
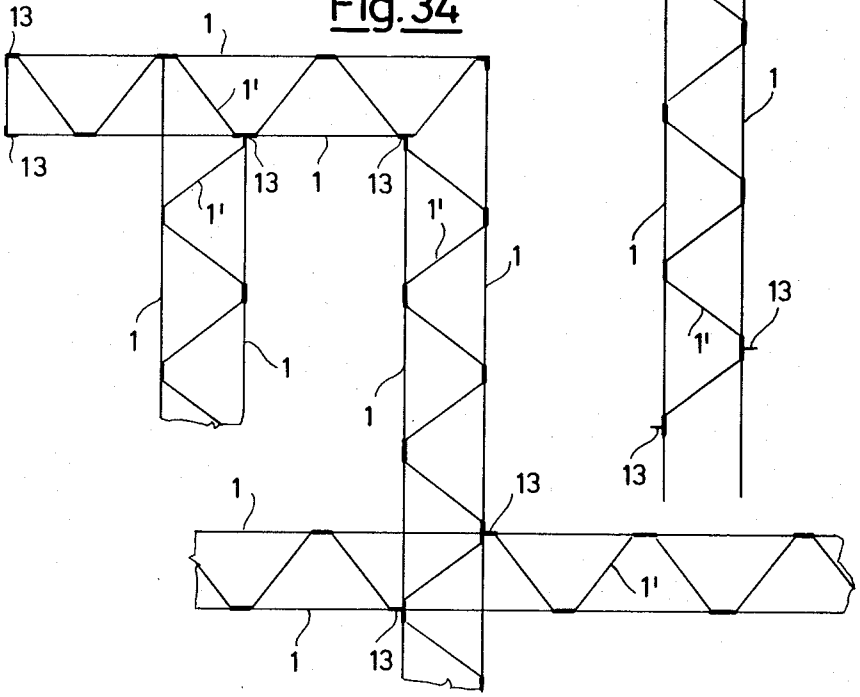
Fig.34

SET OF STANDARDIZED STRUCTURAL ELEMENTS AND ACCESSORIES FOR THE ACCOMPLISHMENT OF SPATIAL AND/OR FLAT STRUCTURES WHICH CAN BE COMBINED TO DELIMIT HABITABLE SPACES IN AN INDUSTRIALIZED BUILDING SYSTEM

The present invention relates to a set of standardized structural elements and accessories for the accomplishment of spatial and/or flat structures which can be combined to delimit habitable spaces in an industrialized building system.

There is a known trend toward seeking to standardize to the greatest extent possible the components to be used in the erection of buildings, whether metal or prefabricated, to reduce the number of said components and hence the cost of construction.

The object of the present invention is to accomplish a set of structural elements and associated accessories which would be variously combinable to allow erection of spatial building structures with a minimal number of components of different forms.

To achieve said object the set of structural elements in accordance with the invention is characterized first in that it comprises rod elements with variable cross section made up of flat equally spaced pads and lengths of straight section connecting said pads.

It is clear that while the connecting lengths of section give the rod elements the necessary resistance to stresses, the flat pads allow perpendicular or oblique crossed overlapping of two or more rod elements for erection of various types of structures.

To erect a flat structure there are provided straight-axis rod elements, i.e. with the lengths of section in alignment.

To erect a spatial structure, there can be used discontinuous rod elements, i.e. with the lengths of section inclined toward each other and toward the flat pads, which are maintained parallel to each other.

Basically the same rod elements with the optional variant of the discontinuous arrangement thus allow erection of either flat or spatial structures with the consequent reduction to the minimum of the number of different components and hence of construction costs.

In structures thus accomplished the flat dimensions are clearly multiples of the pitch between flat pads of the straight-axis rod elements while the height of the structure depends on the aforesaid pitch and on the angle of the bend in the discontinuous rod elements.

In the second place the set of structural elements in accordance with the invention is characterized in that it also comprises square panels, the sides of which are equal to the distance between the flat pads of the straight-axis rod elements, which can replace some of said rod elements in order to accomplish entire flat surfaces and having for this purpose two contiguous sides folded to stiffen said panels.

With said rod-elements and said square panels can be associated surface lining panels also square in shape whose sides are shaped to allow coupling thereof with said elements and said panels, making allowance for the associated sections and foldings.

There are also preferably provided rhomboid covering panels with two contiguous sides having edges folded downward and the other two sides having upward folded edges in such a manner as to allow partial overlapping and mutual coupling of adjacent panels and thus ensure waterproofness of the roof of a structure having minimal slope. The smaller diagonal of the rhombus is equal to the diagonal of the square grid which can be formed with crossed rod elements while its major diagonal exceeds the minor diagonal by a magniture slightly greater than the thickness of the material of which the roofing panels are made.

To allow mutual angled connection of several flat or spatial structures there may also be used in place of some rod elements straight lengths of angle one side of which may have height linearly variable from one end to the other of the lengths of angle. Said lengths of angle may be used also for exterior finishing of the structures and of optional openings therein.

It is important to note that for correct and easy mutual fastening all the elements and panels mentioned above must be provided in advance with appropriately arranged holes. For this purpose the variable-section rod elements have preferably four holes arranged according to the vertices of a square in each flat pad thereof and the flat panels have a similar hole near each corner thereof. The lengths of angle are in turn preferably provided with pairs of similarly spaced holes.

In short, the set of structural elemnts in accordance with the invention lends itself to easy, rapid and economical erection of various kinds of spatial structures with complete standardization and industrialization of the building system.

Figure 2:
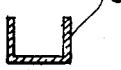
Figure 3:
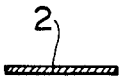
Figure 4:
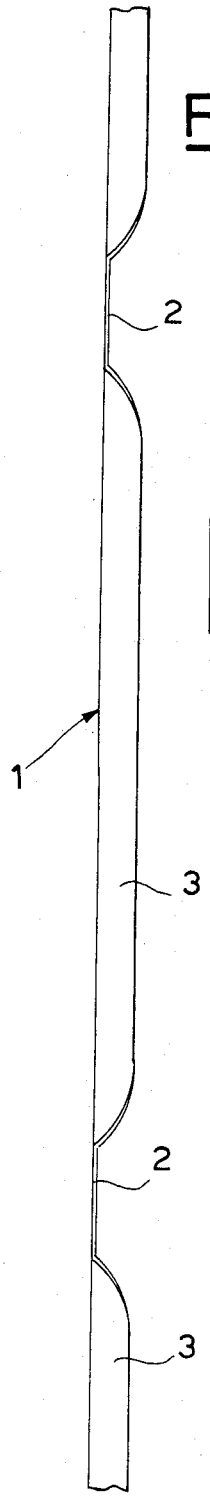
Figure 5:
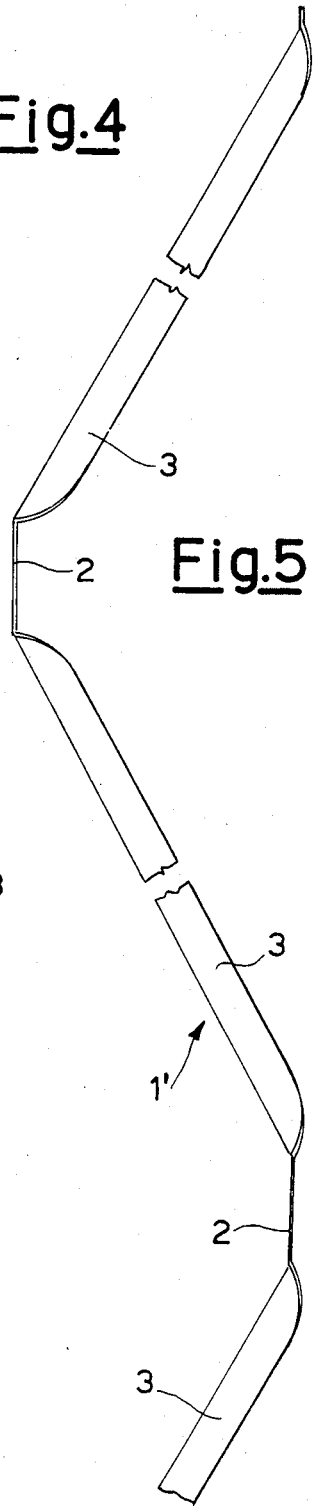
Figures 6, 7, 8, 9, 10, 11:
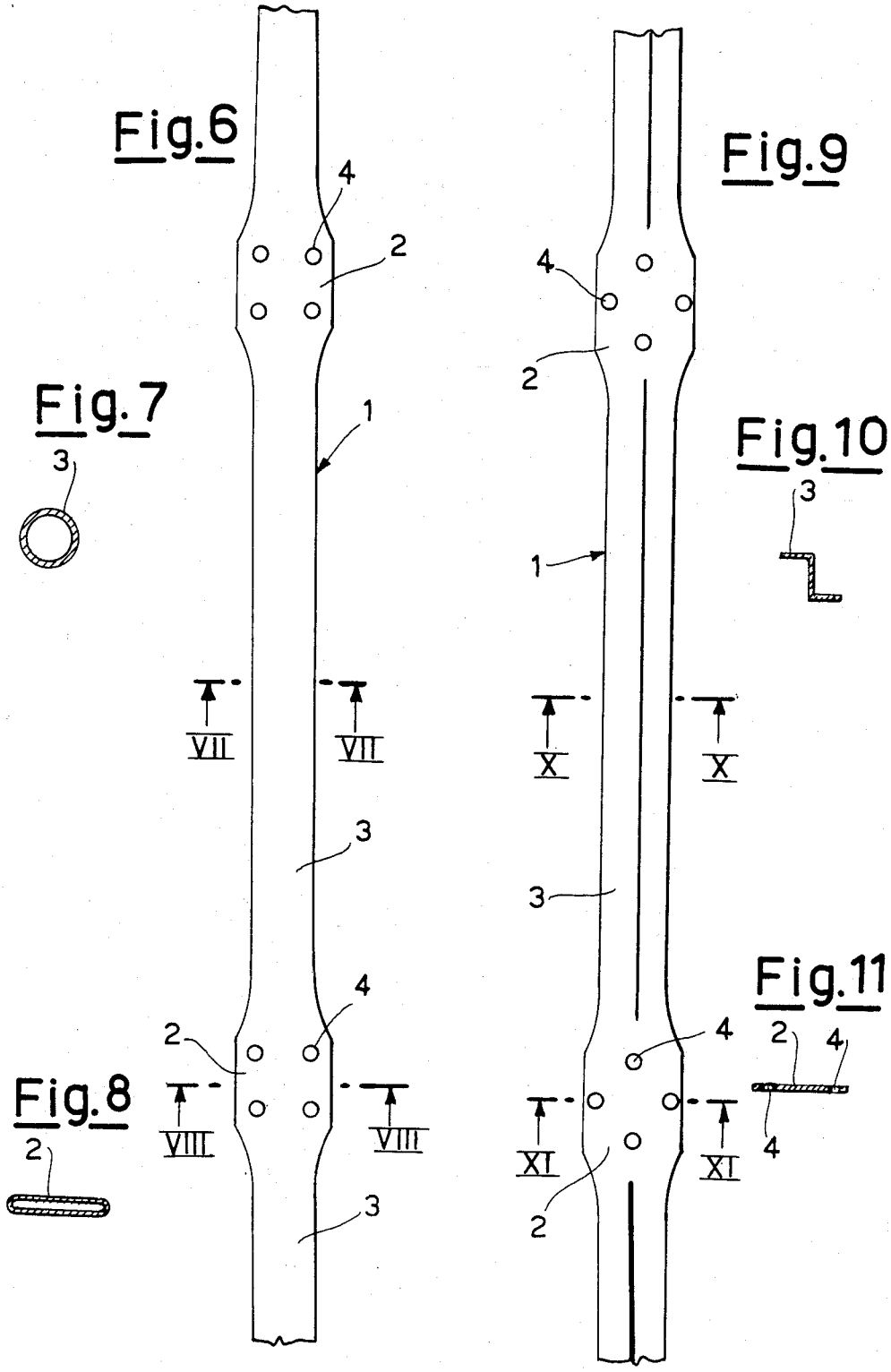
Figures 12, 13, 14, 18, 19, 20, 21:
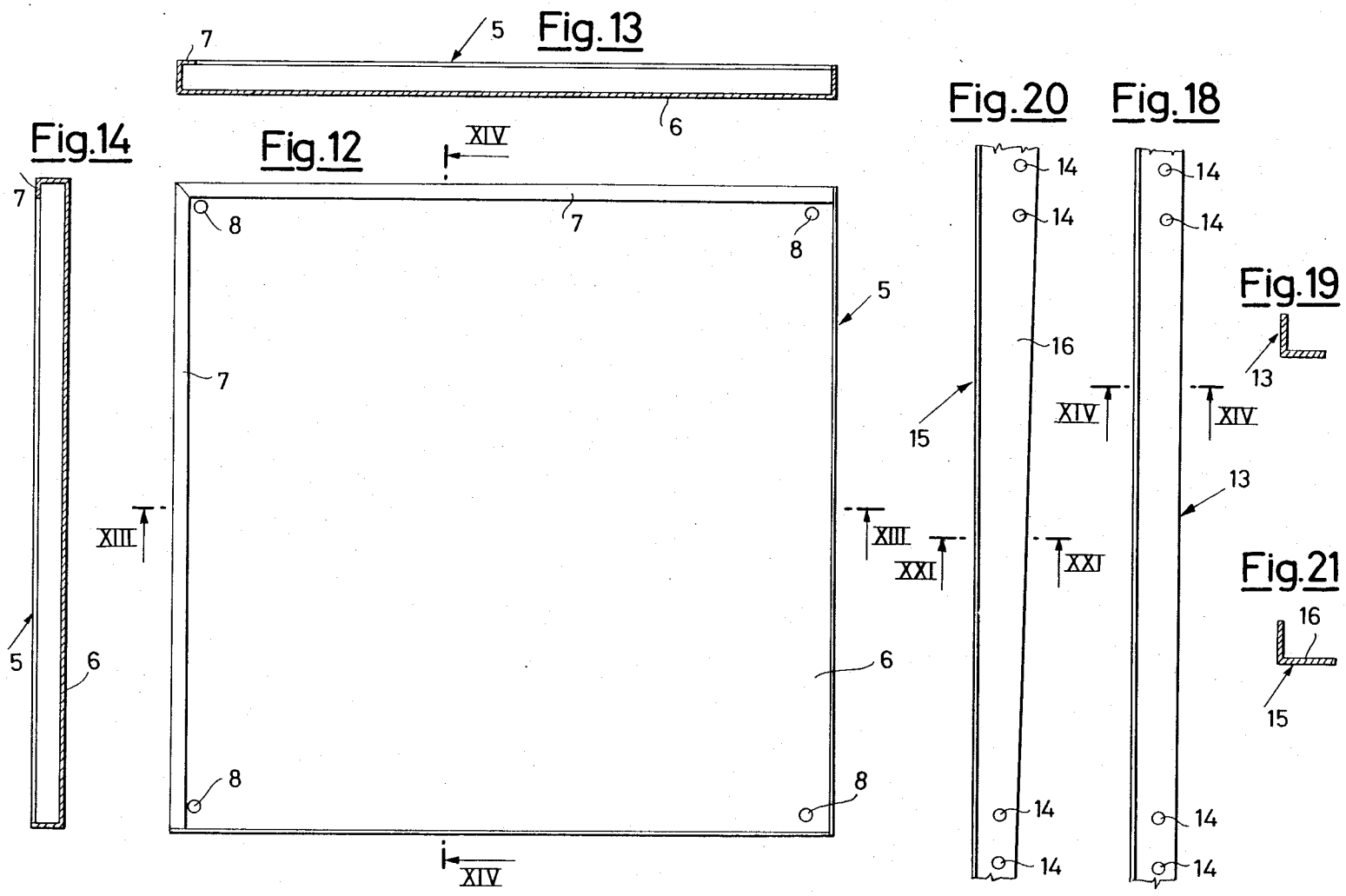
Figure 24:
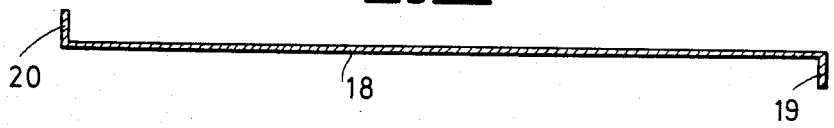
Figure 23:
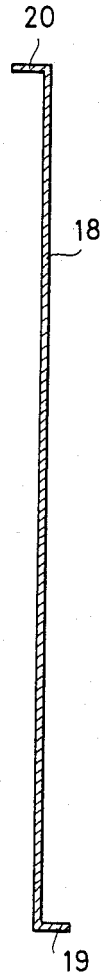
Figure 22:
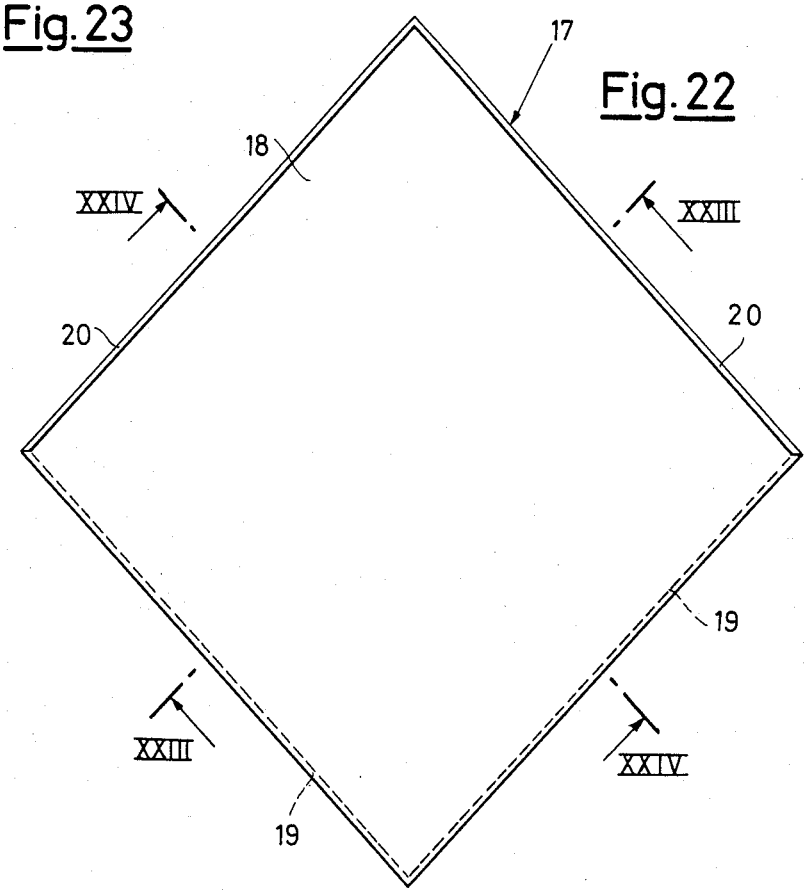
Figure 25:
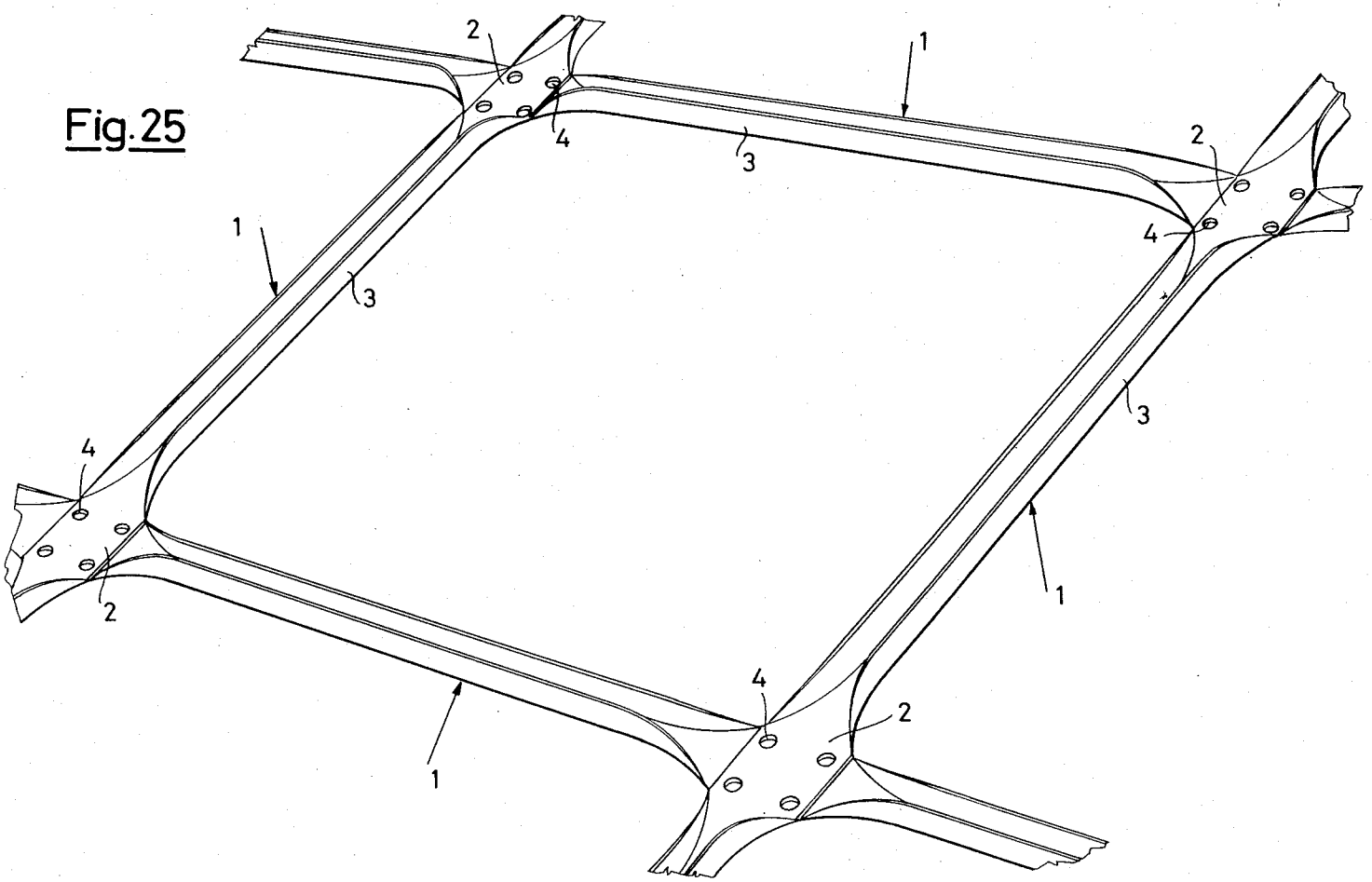
Figure 26:
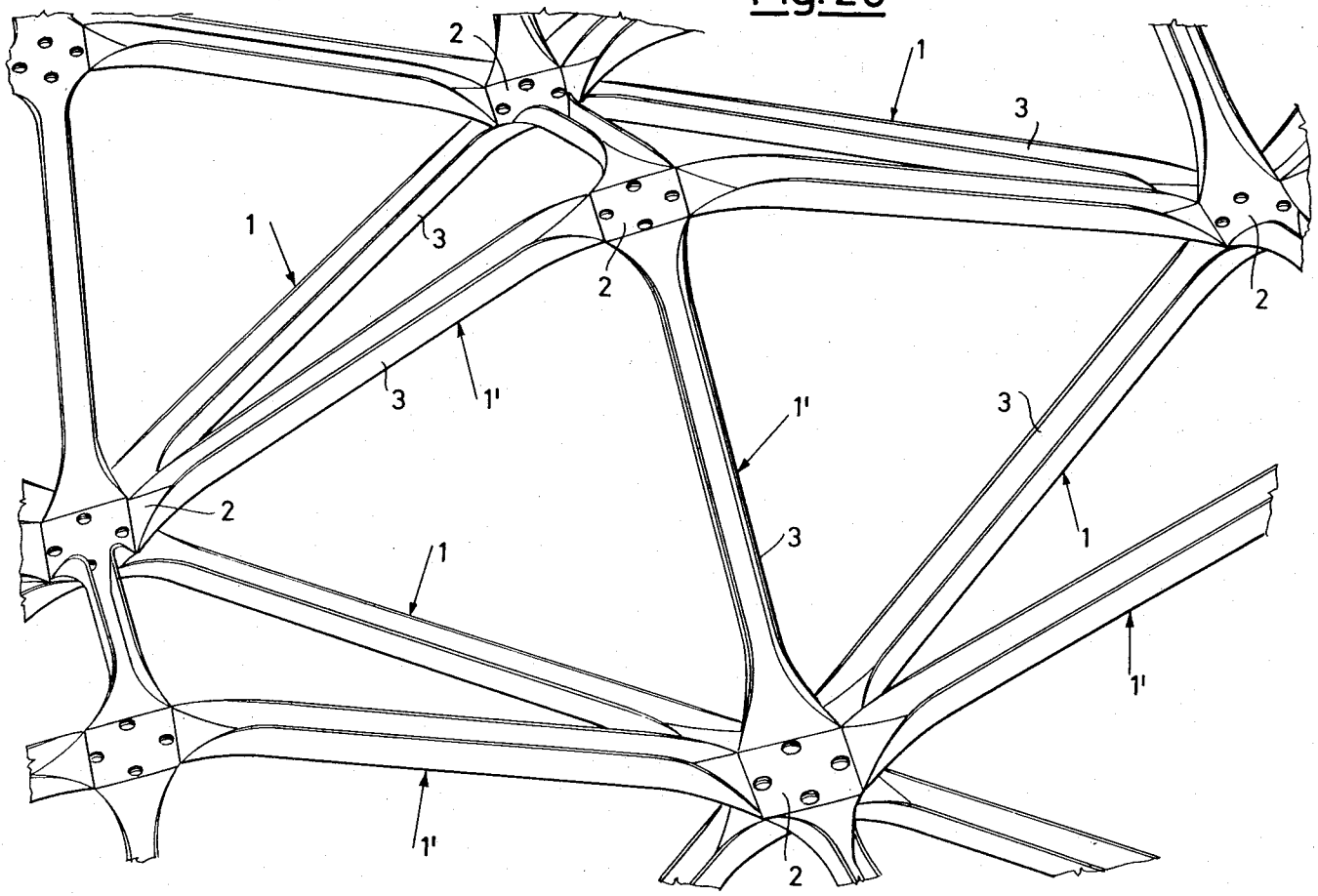
Figure 27:
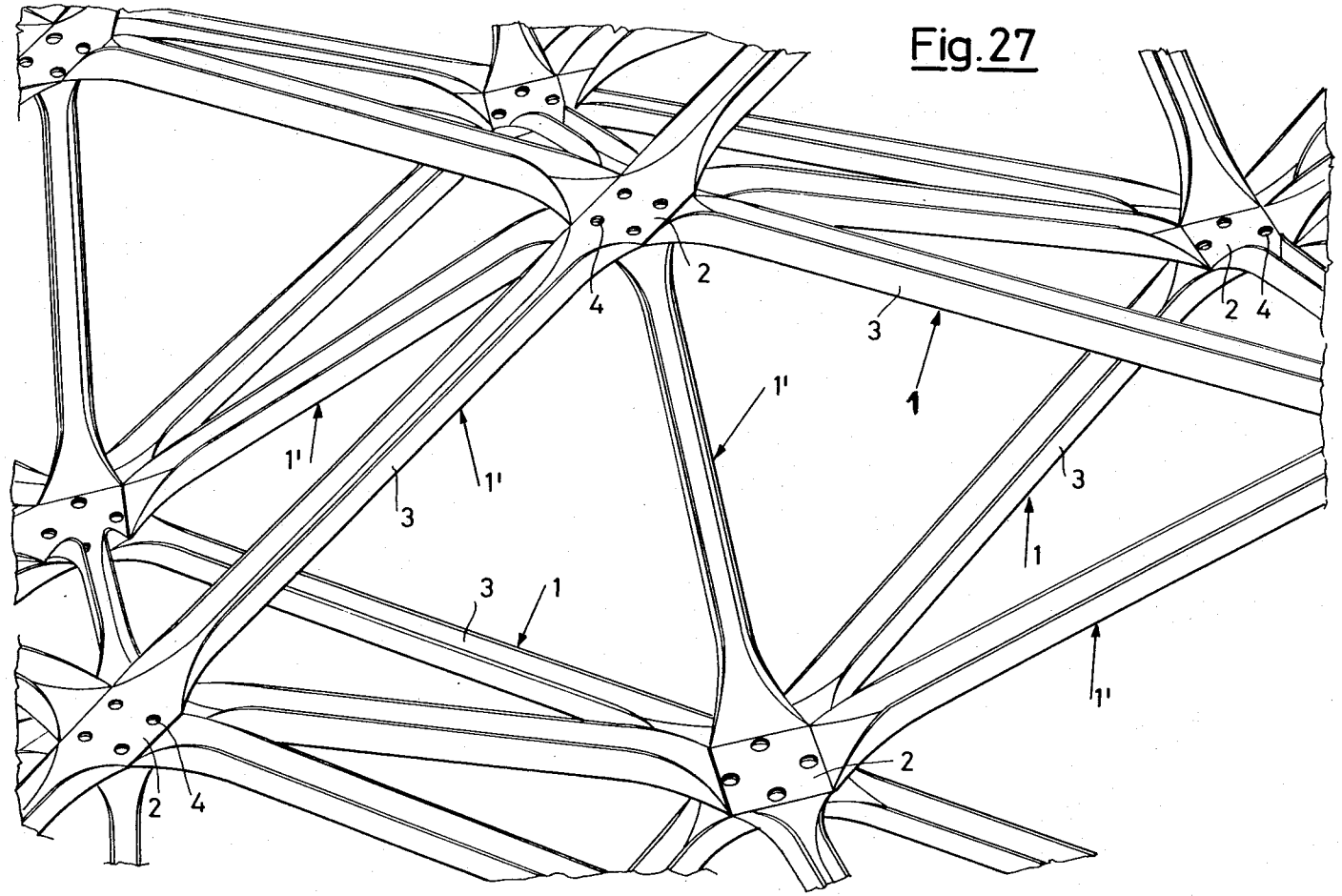
Figure 28:
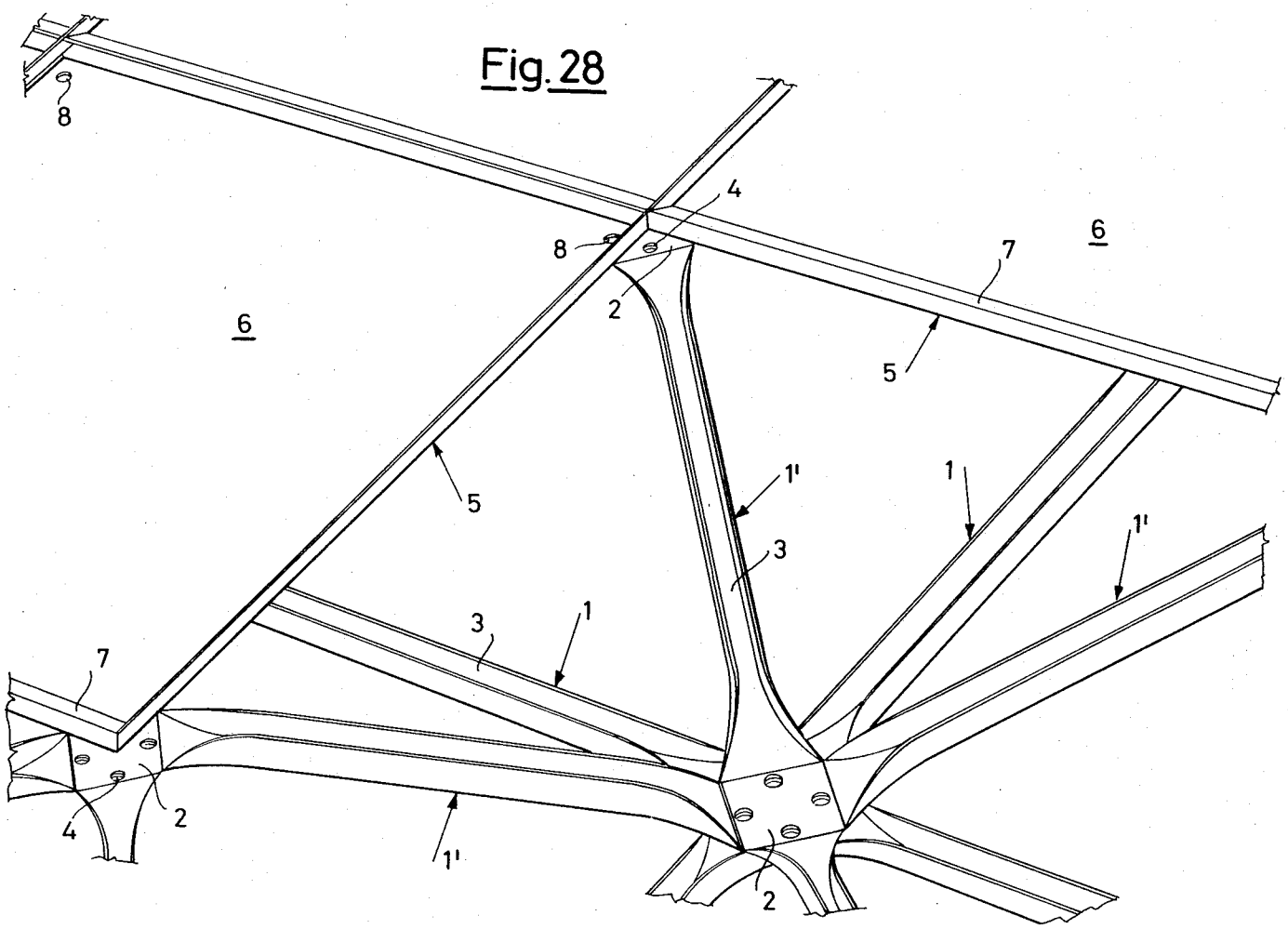
Figure 32:
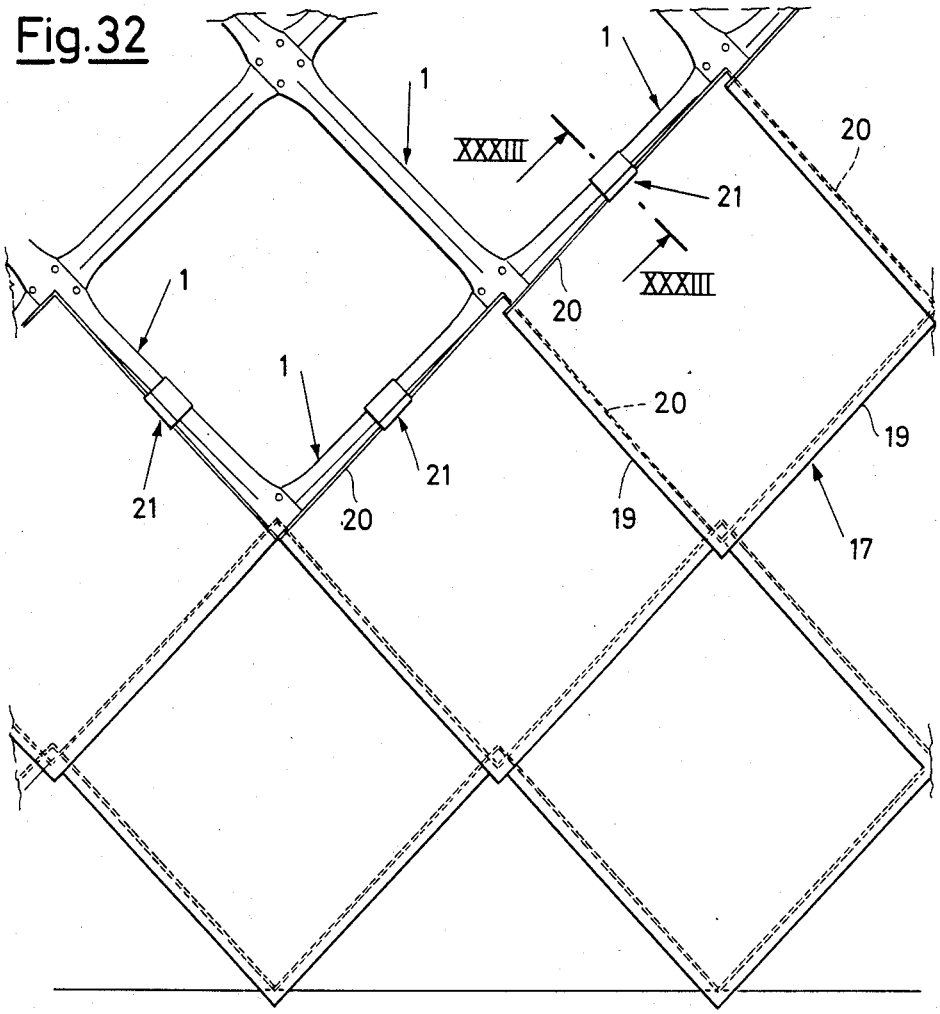
Figure 33:
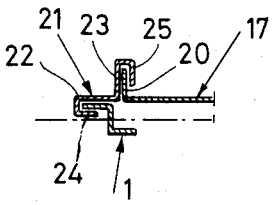

The set of structural elements in accordance with the invention is illustrated for greater clarity as a nonlimiting example together with some possible forms of use in the annexed drawings in which:

FIG. 1 shows a top view of a first type of variable cross-section rod element in accordance with the present invention, FIG. 2 shows a cross section of said first rod element along line II—II of FIG. 1, FIG. 3 shows a cross section of said first rod element along line III—III of FIG. 1, FIG. 4 shows a side view of said first rod element in a completely straight arrangement, FIG. 5 shows a side view of said first rod element bent in discontinuous form, FIG. 6 shows a top view of a second type of variable-section rod element in accordance with the present invention, FIG. 7 shows a cross section of said second rod element along line VII—VII of FIG. 6, FIG. 8 shows a cross section of said second rod element along line VIII—VIII of FIG. 6, FIG. 9 shows a top view of a third type of variable-section rod element in accordance with the present invention, FIG. 10 shows a cross section of said third rod element along line X—X of FIG. 9, FIG. 11 shows a cross section of said third rod element along line XI—XI of FIG. 9, FIG. 12 shows a top view of a square panel in accordance with the invention, FIG. 13 shows a cross section of said panel along line XIII—XIII of FIG. 12, FIG. 14 shows a cross section of said panel along line XIV—XIV of FIG. 12, FIG. 15 shows a top view of a surface lining panel in accordance with the present invention, FIG. 16 shows a side view from below of said surface lining panel in relation to FIG. 15, FIG. 17 shows a cross section of said surface lining panel along line XVII—XVII of FIG. 15, FIG. 18 shows a top view of a first angle element of constant height in accordance with the present invention, FIG. 19 shows a cross section of said first angle element along line XIX—XIX of FIG. 18, FIG. 20 shows a top view of a second angle element of variable height in accordance with the present invention, FIG. 21 shows a cross section of said second angle element along line XXI—XXI of FIG. 20, FIG. 22 shows a top view of a roofing panel in accordance with the present invention, FIG. 23 shows a cross section of said roofing panel along line XXIII—XXIII of FIG. 22, FIG. 24 shows a cross section of said roofing panel along line XXIV—XXIV of FIG. 22, FIGS. 25–27 show perspective views of successive phases of the assembly of variable cross-section rod elements, straight-axis rod elements and discontinuous rod elements for erection of a spatial structure, FIG. 28 shows the association of panels such as those of FIGS. 12–14 with a spatial structure such as that of FIG. 26, FIG. 29 shows a top view of a group of panels such as those of FIGS. 12–14 completed with corresponding surface lining panels such as those of FIGS. 15–17, FIG. 30 shows a cross section of the coupling accomplished between the panels of FIGS. 12–14 and the superimposed lining panels along line XXX—XXX of FIG. 29, FIG. 31 shows a similar coupling accomplishable between said lining panels and rod elements such as those of FIGS. 9–11, FIG. 32 shows a top view of a group of lining panels such as those of FIGS. 22–24 placed in completion of a structure accomplished with the set of structural elements in accordance with the invention, FIG. 33 shows an enlarged cross section of a clamp for interlocking roofing panels and rod elements along line XXXIII—XXXIII of FIG. 32, and FIGS. 34–38 show schematically various uses of the angle elements of FIGS. 18–21 for mutual coupling of mutually perpendicular structures and for finishing said structures.

With specific reference to FIGS. 1–5 there is illustrated a variable-section rod element 1 made of sheet metal which has flat equally spaced pads 2 alternating with straight lengths of section 3, in this case channel. Each flat pad 2 has four holes 4 arranged in accordance with the vertices of a square having sides parallel with and perpendicular to the axis of the rod element. The various lengths of section 3 can be mutually aligned, i.e. the rod element may be entirely straight as illustrated in FIG. 4 or said lengths of section may be inclined alternately with bends of between 60° and 30° in relation to the flat pads, which are parallel to each other, i.e. the rod element may be discontinuous as illustrated and indicated with 1' in FIG. 5.

As an alternative to the rod element of FIGS. 1–5 there can be used the one illustrated in FIGS. 6–8, indicated with the same reference numbers, which has lengths of section 3 with round cross section and flat pads 2 accomplished by flattening said round section at constant intervals. The pads 2 have similar holes 4.

Otherwise there can be used the rod element of FIGS. 9–11, indicated with the same reference numbers, which has lengths of section 3 with double L cross-section, i.e. approximately in the form of a Z, and flat pads 2 having holes 4 arranged at the vertices of a square one diagonal of which coincides with the axis of the rod element and the other is perpendicular thereto.

The panel 5 illustrated in FIGS. 12–14 made of sheet metal is made up of a square flat plate 6, with side equal to the pitch of the pads 2 in the rod elements 1, two contiguous edges 7 of which have a double U fold to stiffen the structure of the panel while the other two edges have single folds. A hole 8 is provided near each corner of the panel at a distance from said corner equal to the distance of each hole 4 of the rod elements 1 from the center of the square described by the four holes 4 of each pad 2.

The surface lining panel 9 of FIGS. 15–17, made of any material, is made up of two flat square plates superimposed and integral 10 and 11, offset laterally to each other and having sides slightly smaller than the side of the panel 5 of FIGS. 12–14. The lower plate 10 is the same height as the panel 5 and has on two sides surmounted by the upper plate 11 a groove designed for connection with a corresponding folded edge 7 of the panel 5.

The angle element 13 illustrated in FIGS. 18 and 19 and made of sheet metal has an L cross-section of constant height and has holes 14 spaced in the same manner as the holes 4 of the rod elements 1. Each pair of holes 14 is spaced from the other in the same manner as the pads 2 of the rod elements 1.

The sectional element 15 illustrated in FIGS. 20 and 21 is fully similar and differs only in that it has one side 16 with linearly increasing height.

The roofing panel 17 illustrated in FIGS. 22–24 and made of sheet metal, asbestos cement, glass fiber reinforced plastic or other waterproof material is made up of a flat plate 18 in rhombus form of which two contiguous sides 19 are folded downward while the other two sides 20 are folded upward. The minor diagonal of the rhombus is equal to the diagonal of a square having for sides four rod elements 1 while its major diagonal exceeds its minor diagonal by a magnitude slightly greater than the thickness of the material of the flat plate 18.

By using the structural elements thus far described with reference to FIGS. 1–24 it is possible to erect flat and spatial structures of various kinds.

In particular as shown in FIG. 25 a flat grid structure can be accomplished by using a plurality of straight-axis rod elements like those of FIG. 4. More precisely, straight rod elements 1 the same length as a side of the structure to be erected are arranged parallel to each other at a distance equal to the pitch of the pads 2 of the rod elements and other sections 1 the same length as the second side of the structure are arranged perpendicular thereto in such a manner as to accomplish overlapping thereof at the pads 2. The overlapping is obtained with perfect alignment of the holes 4 so that mutual coupling is accomplished simply with temporary fasteners such as bolts, rivets, etc. depending on whether a disassemblable structure is desired or not.

From the flat structure of FIG. 25 it is possible to proceed to the spatial structure of FIG. 26 by arranging in accordance with the diagonals of the square frame thus obtained discontinuous rod elements 1' such as those shown in FIG. 5, again with overlapping and mutual fastening of the flat pads. The height of the spatial structure is of course dependent on the slope of the lengths of section 3 of the discontinuous elements 1'.

Erection can then be continued by overlapping of another set of straight elements 1 as illustrated in FIG. 27, then another set of discontinuous elements 1', and so on.

When desired, as illustrated in FIG. 28, some straight elements 1 can be replaced by panels 5 of the type illustrated in FIGS. 12–14, the holes 8 of which can be coupled with the corresponding holes 4 of the rod elements 1 or 1'.

With the panels 5 can be in turn associated and coupled surface lining or finishing panels 9 of the type illustrated in FIGS. 15–17. As shown in FIGS. 29 and 30 coupling is accomplished by fitting the lower plate 10 of each panel 9 in the corresponding flat plate 6 of the panel 5 in such a manner that the two contiguous turned-back edges 7 of the panel 5 engage in the corresponding grooves 12 of the panel 9 (FIG. 30). The protruding parts of the upper plate 11 of the panel 9 thus remain superimposed on the aforesaid turned-back edges 7 of the panel 5 and the protruding parts of the lower plate 10 of the adjacent panel 9. A little play necessary for erection remains between the protruding parts of the lower plate 10 of the panel 9 and the upturned edges of the panel 5.

A similar coupling can be accomplished if desired between the lining panels 9 and the rod elements like the one illustrated in FIGS. 9–11. The type of coupling is shown in FIG. 31.

For the final roofing of the structure there may be used roofing panels 17 like those shown in FIGS. 22–24. Said panels 17 are arranged with one diagonal in the direction of the slope and with its downward-folded edges 19 superimposed onthe upward-folded edges 20 of the adjacent panels 17 (FIG. 32). Each panel 17 can also be coupled to a rod element of the type shown in FIGS. 9–11 (placed on the top of the grid structure formed by the various groups of rod elements) by means of a clamp 21 of the type illustrated in FIG. 33, i.e. with two perpendicular sides 22 and 23 having turned-back edges 24 and 25 designed for coupling respectively with a rod element 1 having a Z cross section and with a turned-back edge 20 of a roofing panel 17.

Finally, FIGS. 34–38 show that angle elements 13 such as the one shown in FIGS. 18 and 19 can be used to join a number of grid structures in miter, T or cross joints as well as for the outer finishing of the structures, in replacement of the rod elements 1. Sections 15 of the type illustrated in FIGS. 20 and 21 can be used in turn when the structure to be joined to the vertical structure must have a slope in relation to the horizontal.

I claim:

1. A set of standardized structural elements and accessories for the construction of building structures comprising:

a first plurality of variable-section rod elements made up of aligned equally spaced flat pads and aligned pad connecting straight section lengths said straight section lengths having a non-planar cross-section, said variable-section rod elements being combinable with each other to form a planar reticular structure, each variable-section rod element having a longitudinal axis;

a second plurality of discontinuous variable-section rod elements made up of parallel equally spaced flat pads and alternately inclined pad connecting straight section lengths said straight section lengths having a non-planar cross-section, said discontinuous, variable-section rod elements being combinable with each other and with said variable-section rod elements to form a spatial reticular structure, each discontinuous variable-section rod element having a longitudinal axis; and a third plurality of panels, said panels being square with a side length equal to a multiple of the distance between successive pads of said variable-section rod elements, said panels being combinable with and superimposable upon said variable-section rod elements to form a continuous surface for said spatial reticular structure.

2. The set according to claim 1, wherein said straight section lengths have a U-shaped cross-section.

3. The set according to claim 1, wherein said straight sections lengths have a round cross-section.

4. The set according to claim 1, wherein said straight section lengths have a Z-shaped cross-section.

5. The set according to claim 1, wherein said pads of said variable-section rod elements and said discontinuous variable-section rod elements are provided with holes arranged at the vertices of a square.

6. The set according to claim 5, wherein said square has two sides parallel to and two sides perpendicular to the longitudinal axis of said rod elements.

7. The set according to claim 5, wherein said square has one diagonal parallel to and the other diagonal perpendicular to the longitudinal axis of the rod element.

8. The set according to claim 1, wherein said panels are square panels having two contiguous edges with a double fold and the two other edges having a single fold.

9. The set according to claim 8, wherein said pads of said rod elements are provided with holes arranged at the vertices of a square, said square having a center, and said square panels are provided with at least one hole near each corner of said square panel at a distance therefrom equal to the distance of each hole of the pads of the rod elements from said center of said square.

10. The set according to claim 8, further comprising a fourth plurality of lining panels made up of a square lower plate, adapted for insertion in one of said square panels under said edges with a double fold, and a square upper plate having two contiguous edges partially protruding from said lower plate so as to be superimposable over said edges with a double fold.

11. The set according to claim 1, further comprising a fifth plurality of roofing panels of rhombic shape having two contiguous edges folded downwards and the two other edges folded upward, said roofing panels having a predetermined thickness.

12. The set according to claim 11, wherein said roofing panels have a minor diagonal equal to the diagonal of a square grid made up of four of said first plurality of rod elements perpendicular to each other and a major diagonal which exceeds said minor diagonal by substantially the thickness of said roofing panels.

13. The set according to claim 1, further comprising a sixth plurality of first angle elements having an L-shaped cross-section of constant height.

14. The set according to claim 13, wherein said pads of said variable-section rod elements are provided with holes arranged at the vertices of a square and said first angle elements have pairs of holes spaced apart the same as two contiguous vertices of said square, said pairs of holes being spaced from one another by a distance equal to the spacing of said pads of said variable-section rod elements.

15. The set according to claim 1, further comprising a seventh plurality of second angle elements having an L-shaped cross-section of linearly increasing height.

16. The set according to claim 15, wherein said pads of said variable-section rod elements are provided with holes arranged at the vertices of a square and said second angle elements have pairs of holes spaced apart the same as two contiguous vertices of said square, and pairs of holes being spaced from one another by a distance equal to the spacing of said pads of said variable-section rod elements.

* * * * *